US005722865A

United States Patent [19]

Tatum

[11] Patent Number: 5,722,865

[45] Date of Patent: Mar. 3, 1998

[54] CANARD BALANCED MARINE BICYCLE

[76] Inventor: George W. Tatum, 4333 Electric Rd. Apt. 8H, Roanoke, Va. 24014

[21] Appl. No.: 651,677

[22] Filed: May 21, 1996

[51] Int. Cl.[6] ..... B63H 21/175

[52] U.S. Cl. ..... 440/12; 440/30

[58] Field of Search ..... 440/12, 13, 21, 440/29, 30, 31; 114/271, 274

[56] References Cited

U.S. PATENT DOCUMENTS

| | | | |
|---|---|---|---|
| 621,465 | 3/1899 | Storms | 440/29 |
| 2,323,261 | 6/1943 | Vigo | 440/30 |
| 2,420,422 | 5/1947 | Gilliam | 440/31 |
| 3,352,276 | 11/1967 | Zimmerman | 440/31 |
| 4,474,502 | 10/1984 | Daoud | 440/29 |
| 5,362,264 | 11/1994 | Parant | 440/30 |

*Primary Examiner*—Stephen Avila
*Attorney, Agent, or Firm*—Woods, Rogers & Hazlegrove, PLC.; C. Fred Rosenbaum

[57] ABSTRACT

The canard balanced marine bicycle is an aquatic vehicle having a long and very narrow hull which depends, for its stability, on the dynamic forces generated by its movement through the water acting on the canard. The canard depends from the bottom of the hull and is movable about its axis by handlebars controlled by the rider. The vehicle is powered by the rider through the manipulation of pedals which drive a propulsion system. The vehicle is guided by a steerable rudder operated by controls located on the handlebars.

19 Claims, 2 Drawing Sheets

CANARD BALANCED MARINE BICYCLE

BACKGROUND OF THE INVENTION

1. Field of the Invention

The present invention pertains to human powered water craft. More particularly, the invention relates to a vessel propelled by the muscle power of the rider through manipulation of pedals. The pedals are interconnected with a mechanism which reacts with the water within which the craft is immersed to provide locomotion for the vessel. The water craft is provided with a stabilizing element which obtains its function through dynamic reaction with the water through which it moves.

2. Description of the Prior Art

Pedal driven water craft tend to be heavy, unwieldy and unseaworthy. This is primarily due to the major problem of pedal boat design which is the conflict between seaworthiness and weight. The craft should be seaworthy to prevent capsizing, broaching or submerging thereby maintaining the rider out of the water. The conventional pedal boat designs attempt to provide seaworthiness by using size and weight to provide stability. However, the craft should also be light enough to be capable of movement through the water by the use of the muscle power of the rider. Therefore, the result of the conflict is prior art craft marginally seaworthy in order to save weight and only capable of relatively slow movement through the efforts of the rider. In addition to being slow, the prior art pedal boats lack precise maneuverability. Because of these limitations, prior art pedal boats are normally operated close to shore in well protected bodies of water.

The prior art reveals three solutions to the seaworthiness problem. The first is a single hull with a weighted keel. The second is a multiple hull or float system. The third is a flat self balancing hull. All have serious drawbacks.

For the single hull with a weighted keel the keel must equal the weight of the rider and machinery. Although this system has the performance characteristics of a mono-hull, the weight involved works against the limited power a human can generate.

The multiple hull system tends to be lighter and therefore, faster, than the heavy keel craft. However, multiple hulls present a wide profile in the water which hinders maneuverability and adds drag requiring more effort by the rider. The multiple hull is usually of much shallower draft than the keel boat resulting in instability in anything but the calmest of waters.

The flat hull shares the disadvantages created by the width and draft of the multi-hull system. The unitary hull has more wetted surface than the multiple-hull and this produces more weight and drag. Because of these features, the flat hull tends to be even slower and less manuerverable than the others.

None of the prior art pedal boats have a system for providing seaworthiness, maneuverability and speed by dynamic balance of the forces operating upon the craft as it moves through the water.

SUMMARY OF THE INVENTION

Instead of the weighted keel, flat hull or multi-hull system, the present invention is directed to a canard balance system. The canard is located near the middle of the craft and is operated by the rider to balance the boat. This allows the pedal boat to be built top heavy, light and thin. These qualities allow dramatically increased performance in speed, seaworthiness and maneuverability. The single narrow hull is inherently seaworthy because it can "cut through" waves when necessary. There is no problem of tipping caused by a shifting water plane operating against a flat surface or multiple hulls. The reduced size and width of the hull result in sharply reduced drag and weight which are critical factors in pedal boat design because of the limitations of human-generated power.

The canard balance system coupled with a single narrow hull produces a craft which mimics the riding characteristics of a land bicycle, e.g. the rider can turn sharply, lean the boat into turns, and rock the boat in high energy efforts.

The craft of this invention may be operated in large unprotected bodies of water, such as lakes, rivers and the ocean. The craft can travel substantial distances for exercise, pleasure and exploring. The craft may be used as a trig device for developing muscular and cardiovascular endurance, as well as defining balance at slow and substantial speed. The craft can be operated continuously for substantial lengths of time, e.g. two hours or more. It can travel approximately sixteen miles in five hours. The craft may be used for competition with other similar craft.

Further objects and advantages of my invention will become apparent from a consideration of the drawings and the ensuing description.

DETAILED DESCRIPTION

Figure 1:
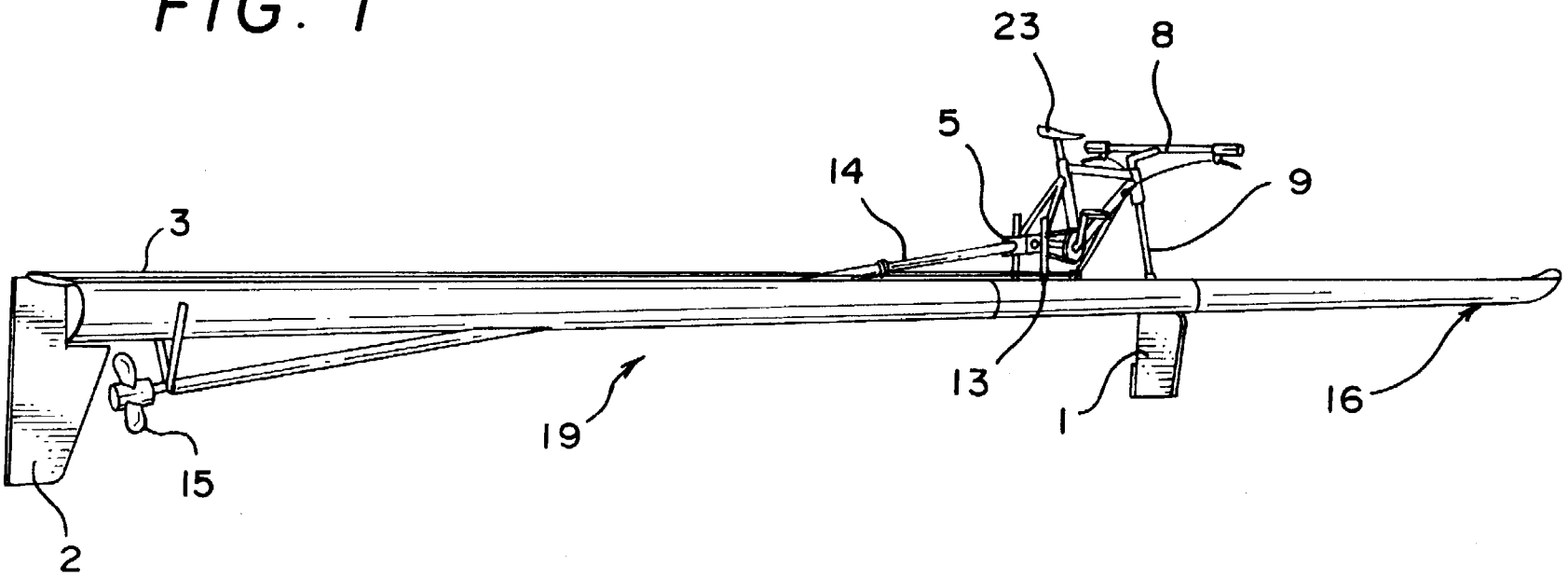
FIG. 1 is a perspective view of the boat.
Figure 2:
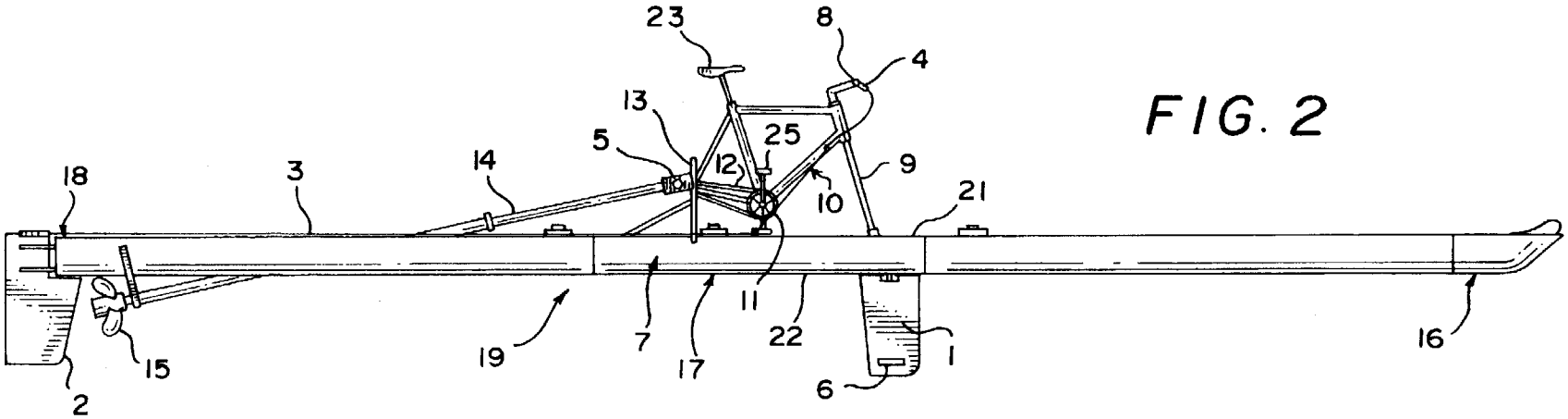
FIG. 2 is a side view of the boat.
Figure 3:
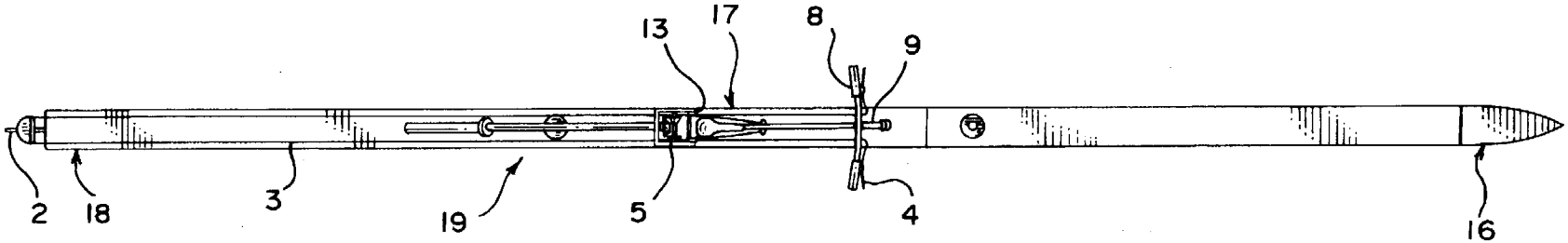
FIG. 3 is an overhead view of the boat.

As shown in FIGS. 1, 2, and 3, the marine bicycle 19 has a long narrow boat hull 7 with a sharp bow 16 at the front end, a broad stern 18 at the rear end, an upper surface deck 21, and a bottom 22. Depending from the bottom 22 is a canard fin 1 shown in FIGS. 1 and 2. The canard is mounted on the hull 7 near the center of the boat. The canard 1 rotates about an axis perpendicular to the longitudinal axis of the hull 7. However, the plan form of the canard may depend from the hull with the leading edge at a greater or lesser angle than 90 degrees. The canard fin has a canard weight 6 mounted on the bottom. A steering rudder 2 is movably mounted on the stern 18 of the boat hull to provide directional control The hull 7 may be of any shape commensurate with hull design. The hull provides positive buoyancy for the craft allowing the craft to float in the water. As shown, the hull 7 is tubular. This form lends itself to construction from prefabricated tubing.

A support frame 10 is mounted on the deck 21 near the boat's center. The support frame has several elements which provide support for the rider, propulsion for the boat and control of the canard and rudder. The support frame is connected to the deck by a rear frame jig 13 located toward the stern and the canard tube 9 located toward the bow. As shown in FIG. 2, the support frame is similar to a bicycle frame with integral rigid frame members formed to spatially fix the saddle seat 23 for support of the rider, the crank 11 with the pedals 25 for generating propulsion, and the handlebars 8 to control the canard. The canard tube 9 carries the control member for rotating the canard. The control member and the canard are rotated by moving the handlebars to the port or starboard in a plane parallel to the deck. The support frame may be made in other shapes and designs differing from the bicycle frame. It is only necessary that there be a support for the rider with the crank and the directional and balance controls placed within reach of the rider's limbs.

The rear frame jig also carries the transmission 5. The transmission 5 is connected to the crank by a chain 12 or any other flexible drive. The transmission contains a set of gears which translates the input from the flexible drive through 90 degrees to provide an output rotating the propeller shaft 14. The transmission converts the force generated by the rider moving the crank into rotary motion turning the propeller shaft 14 and thus the propeller 15. The propeller shaft passes through the hull in a propeller shaft housing 24.

The rudder 2 is controlled by the steering cables 3, one each on the port and starboard sides of the rudder. The steering cables are manipulated by the respective cable levers 4 located on the handlebars. To move the rudder from amidship, the rider actuates either the port or starboard cable lever which foreshortens the respective steering cable displacing the rudder.

As shown, the boat disassembles into the following six parts; the bow section 16, the midsection 17, the stern section 18, the support frame 10, the rudder 2, and the canard fin 1. This disassembly allows for easy transportation and storage. Each hull section is provided with a plug 20 for access to the interior of the hull. By way of example and not restriction, the boat may be 26 feet in length, with a hull diameter of 8 inches, and with a 10 inches long canard depending from the bottom about 22 inches. The length of the hull may vary between approximately 12 feet and 30 feet. The beam or diameter of the hull may vary between 6 inches and 12 inches. The plan form of the canard may take many shapes. The canard weight 6 counterbalances the weight of the support frame and other structure above the deck to prevent the craft from completely capsizing or turning turtle. The untended craft would tend to float on it's side.

In operation, the addition of the rider's weight makes the boat extremely top heavy. This results in an unstable condition in which the boat will tend to rollabout it's longitudinal axis. To balance the boat at a standstill, the rider, in addition to shifting body weight in the direction opposite the direction of the roll, rotates the canard fin by turning the handlebars 8 into the direction of the roll. The combination of the resistance of the canard fin and the canard weight 6 will tend to overcome the rolling force until forward motion is developed. To balance the boat underway, the rider does the same as above. However, the forward motion of the canard through the water produces lift which operates to counter the rolling force.

Under way, the canard balanced marine bicycle is a light, fast and maneuverable craft. It possesses a balance dynamic similar to a road bicycle, yet the dynamic also has unique qualities. The extreme lift forces produced by the canard allow for tremendous balance capabilities and rider error. With exceptional balance control and the nimble performance characteristics of a slim monohull, this boat can be operated at relatively high speeds and in a variety of water conditions.

Although the detailed description relates to the drawings shown, this description should not be construed as limiting the scope of the invention but, rather, as providing explanation of the present embodiment of a canard balanced marine bicycle. Many other variations are possible, e. g. the canard balance effect could be achieved by using more than one canard rotated by the handlebars. The placement of the canard could be moved from the center of the boat to alter the steering and balance dynamics of the boat. The canard could be made to turn on only one side of the turning axis of the canard tube rather than the center-balanced canard shown. The canard could be mounted on a stationary fin. The canard weight could be eliminated in embodiments for more advanced riders. Similarly, steering could be accomplished by a front fin, a back fin, or both. The steering action of the rudder or steering fin or fins could be mechanically linked to the rotation of the handlebars to even further mimic the riding dynamic of the road bicycle. The length of the hull could be increased to achieve greater hull speed or decreased to achieve greater maneuverability and superior portability. The hull could be designed so as to encase many moving parts or the craft could be designed as a single unit with no separable frame. The materials from which the craft is made should be light, strong and remain rust and corrosion free, e.g. fiberglass, plastics, aluminum, etc. The boat could be propelled by different impelling systems, such as, a paddle wheel, turbine or other marine impelling mechanism. A "kick stand" type mechanism employing floats or other means could be added to the craft to provide stability while the rider is at rest.

I claim:

1. A rider powered water craft comprising an elongated hull having a narrow bow, a broad stern, a deck and a bottom, support means attached to said deck for supporting a rider, a crank means attached on said deck such that a rider on said support means can operate said crank means, an impeller means mounted on said hull for propelling said craft through the water, said impeller means operatively connected with said crank means so that movement of said crank means results in movement of said impeller means, rudder means mounted on said hull for providing directional control of said craft, and canard means mounted on said bottom for rotation about an axis perpendicular to the longitudinal axis of said hull, said canard means rotated by a rider, said hull, support means, crank means, impeller means, rudder means, and canard being inherently unstable and incapable of maintaining an upright position without balance input by a rider, said canard means providing dynamic balance input when rotated by a rider to oppose the rolling moment of the craft.

2. A rider powered water craft of claim 1, wherein said elongated hull has a length to beam ratio of from 60:1 to 12:1.

3. A rider powered water craft of claim 1, wherein said hull provides sufficient buoyancy for the craft to float when placed in a body of water.

4. A rider powered water craft of claim 1, wherein said canard means is located approximately half way between said bow and said stern.

5. A rider powered water craft of claim 1, wherein said support means comprises an integral rigid frame member with a saddle seat and having a rear jig and a canard tube, said saddle seat located between said rear jig and said canard tube, said frame member attached to said deck by said rear jig member toward the stern and said canard tube toward the bow.

6. A rider powered water craft of claim 5, wherein said canard tube and said rear jig are located on said deck fore and aft, respectively, of said crank means locating said saddle seat vertically above said crank means.

7. A rider powered water craft of claim 6, wherein said crank means comprises a wheel mounted to rotate in a vertical plane relative to said craft having horizontally extending pedals operated by a rider.

8. A rider powered craft of claim 7, wherein said crank means is mounted on said frame member.

9. A rider powered water craft of claim 1, wherein a transmission means operatively connects said impeller means and said crank means, said transmission means having a crank input means and an impeller output means, said crank input means and said crank means being operatively connected by drive means.

10. A rider powered water craft of claim 9, wherein said crank means comprises a wheel mounted to rotate in the vertical plane having horizontally extending pedals to be operated by a rider, said wheel having a toothed circumference engaging said drive means, said drive means in the form of a chain and said crank input means on said .transmission means having a cooperative toothed crank input wheel.

11. A rider powered water craft of claim 10, wherein said transmission is mounted on said rear jig and said impeller output means comprises a set of gears, said impeller means comprising a propeller shaft, said propeller shaft extending through said hull and having a propeller at one end and a complementary gear at the other end cooperatively engaging said set of gears of said impeller output means.

12. A rider powered water craft of claim 1, wherein said rudder means is a thin wing shaped appendage extending below the bottom of said hull and movably mounted on said hull to rotate about an axis perpendicular to said hull, the rotation of said appendage controlled by a steering mechanism operated by the rider.

13. A rider powered water craft of claim 12, wherein said steering mechanism is made up of a steering cable connected to said appendage, running to said support means and terminating in an actuation device mounted on said support means.

14. A rider powered water craft of claim 1, wherein said canard means comprises a wing shaped structure depending from said bottom of said hull rotatably connected through said hull to said support means, a rotation means mounted on said support means for rotating said canard.

15. A rider powered water craft of claim 5, wherein said canard tube carries a lever at one end rotatably connected through the other end of said canard tube and through said hull to said canard means.

16. A rider powered water craft of claim 15, wherein said lever is in the form of handlebars.

17. A rider powered water craft of claim 13, wherein said support means comprises a canard tube, said canard tube carrying handlebars at one end thereof, said actuation device being in the form of a lever with a fulcrum intermediate the ends thereof, said fulcrum attached to said handlebars, said steering cable attached to one end of said lever whereby when a rider moves the other end of said lever said steering cable is displaced moving said rudder.

18. A rider powered water craft of claim 17, wherein steering cables are connected to said rudder, one to the port side and one to the starboard side, said cables each being attached to actuation devices, one each on the port and starboard sides of said handlebars.

19. A rider powered water craft comprising a long narrow hull, said hull providing adequate buoyancy to maintain the craft afloat, said hull having a tendency to roll about it's longitudinal axis, a bicycle frame aligned with the longitudinal axis of said hull mounted on said hull approximately amidships, said bicycle frame having a hollow front frame member in the form of a canard tube carrying handlebars at one end and attached to said hull at the other end, said handlebars attached to a canard through said canard tube and said hull, said canard rotating in the axis perpendicular to said hull in response to rotation of said handlebars, said bicycle frame having a rear jig carrying a transmission and attached to said hull, said bicycle frame including a seat and a crank located between said canard tube and said rear jig, said crank including pedals for manual power, said crank is connected to the input of said transmission by a flexible drive means, the output of said transmission is rotatably connected to one end of a propeller shaft, said propeller shaft extends from said transmission through said hull and carries a propeller at the other end, a rudder mounted on said hull for directional control, said rudder rotated through steering cables connected to each side of said rudder, running along said hull and terminating with pivoting levers mounted on said handlebars, whereby when a rider is aboard the tendency to roll about the longitudinal axis is overcome by the manipulation of said canard through said handlebars and production of forward motion through said propeller establishing a dynamic balance.

* * * * *